US005927487A

United States Patent [19]

Whittle et al.

[11] Patent Number: 5,927,487

[45] Date of Patent: Jul. 27, 1999

[54] TILTABLE TRAY ASSEMBLY FOR STORING AND DISPLAYING ARTICLES AND THE LIKE

[75] Inventors: Paul D. Whittle, Louisville; Nora H. McCray, Boulder; Anna Zapp, Lafayette, all of Colo.

[73] Assignee: Sew-Ergo, Inc., Lafayette, Colo.

[21] Appl. No.: 09/042,660

[22] Filed: Mar. 17, 1998

[51] Int. Cl.[6] ..... B65D 5/52; B65D 43/14

[52] U.S. Cl. ..... 206/45.2; 206/1.5; 206/45.24; 220/337

[58] Field of Search ..... 206/45.2, 45.23, 206/45.24, 1.5; 220/337, 338, 340, 343

[56] References Cited

U.S. PATENT DOCUMENTS

| | | | |
|---|---|---|---|
| 457,598 | 8/1891 | Briggs | 206/45.3 |
| 690,341 | 12/1901 | Young | 206/45.24 |
| 1,671,998 | 6/1928 | Rose | 206/45.2 |
| 3,913,711 | 10/1975 | Schmid | 206/45.23 |
| 4,053,047 | 10/1977 | Andreaggi | 206/45.2 |
| 4,259,568 | 3/1981 | Dynesen | 206/45.2 |
| 4,588,074 | 5/1986 | Strong et al. | 206/45.2 |
| 4,634,001 | 1/1987 | Wakelin | 206/45.2 |
| 5,007,530 | 4/1991 | Weismantel | 206/45.23 |

*Primary Examiner*—Paul T. Sewell
*Assistant Examiner*—J. Mohandeai
*Attorney, Agent, or Firm*—Emery L. Tracy

[57] ABSTRACT

A tray assembly for storing articles and displaying articles upon a supporting surface is provided. The tray assembly comprises a tray container defining a hollow encasement portion with the hollow encasement portion holding the articles. A cover lid is pivotally secured to the tray container. The cover lid is movable from a storing position covering the hollow encasement portion to a displaying position wherein the cover lid supports the tray container at a predetermined tilt angle between the tray container and the supporting surface.

13 Claims, 7 Drawing Sheets

10
64
52
14
54
62
12
18
60

10
64
72
40
14
78
16
62
58
60
20
40
12

10
12
14
18
32
34
52
54
56
58
60
62
64
72
75
77
79
90
92
94

TILTABLE TRAY ASSEMBLY FOR STORING AND DISPLAYING ARTICLES AND THE LIKE

BACKGROUND OF THE INVENTION

1. Field of the Invention

This invention relates generally to a tiltable tray assembly for storing and displaying articles and the like and, more particularly, it relates to a tiltable tray assembly for storing and displaying articles and the like which stores various articles and displays the various articles on a supporting surface in either a substantially horizontal relationship to the surface or at a predetermined angle relative to the surface.

2. Description of the Prior Art

Tray systems for storing and displaying items and utensils are known in the prior art. Unfortunately, the tray systems of the prior art merely stores and displays the items and utensils in a substantially horizontal position relative to the supporting surface upon which the tray system is rested. The user of the tray system continually has to strain and bend to view the contents of the tray system. Over a period of time, the user of the tray system will become fatigued and exhausted by the strain and duress of having to locate items and utensils within the tray system. None of the tray systems adequately store the items and utensils and then display the items and utensils to minimize and inhibit fatigue and exhaustion and to increase the ease of access to the items and utensils within the tray system by the user.

The above is particularly true for tray systems used for light assembly, i.e., sewing operations. Typically, these tray systems have been positioned on a supporting surface in a flat horizontal position. The horizontal placement generally causes the operator to retain a difficult body position in order to view, locate, and retrieve an item for use in assembly. For example, when a sewing operator is sewing, he or she is in a stationary seating position and needs to lead awkwardly to one side at an uncomfortable angle for the neck, wrist, and shoulder, to retrieve materials and tools. Often, lie or she will need to stand up to see the tool area or assume an ergonomically incorrect and uncomfortable seating position. Injury can occur after repetitive movements resulting in wrist, neck, or shoulder injury.

Currently, an increased awareness of ergonomic and body friendly workstations exists in many industries. In fact, may professional seamstresses, other sewing operators, and assembly workers suffer from muscular and skeletal problems of the neck, shoulders, back, hips, wrists, and other body parts due to poor ergonomic posture and operational working positions at their workstation. The operator's posture is constrained by the visual limitations of the sewing workstation. For the sewing machine operator, as in other professions, it is important to provide a correct ergonomic work station for better vision of the materials need to work with, more physical comfort often resulting in better productivity and worker longevity.

Accordingly, there exists a need for a tiltable tray assembly for storing and displaying articles and the like which selectively securely maintains the articles within the system during the storage mode. Additionally, there exists a need for a tiltable tray assembly for storing and displaying articles and the like which during a displaying mode allows the articles to be displayed on a surface at either a substantially horizontal relationship to the surface or at a predetermined angle relative to the surface to increase correct ergonomic posture of the user. Furthermore, there exists a need for a tiltable tray assembly for storing and displaying articles and the like which is compartmentalized for allowing various articles to be stored within the tray assembly while maintaining each distinct article separate from each and every other article.

SUMMARY OF THE INVENTION

The present invention is a tray assembly for storing articles and displaying articles upon a supporting surface. The tray assembly comprises a tray container defining a hollow encasement portion with the hollow encasement portion holding the articles. A cover lid is pivotally secured to the tray container. The cover lid is movable from a storing position covering the hollow encasement portion to a displaying position wherein the cover lid supports the tray container at a predetermined tilt angle between the tray container and the supporting surface.

In an embodiment of the present invention, the tray container has a base wall, a front wall connected to the base wall, and a back wall connected to the base wall with the back wall being angled relative to the base wall. Furthermore, in an embodiment of the present invention, the cover lid includes a first cover lid portion pivotally connected to the tray container, a second cover lid portion, and hinge means connecting the first cover lid portion to the second cover lid portion for pivoting the second cover lid portion relative to the first cover lid portion. Preferably, the hinge means is a living hinge.

In another embodiment of the present invention, the tray assembly further comprises first securing means associated with the tray container and the cover lid for releasably securing the cover lid to the tray container in the storing position. Furthermore, in an embodiment of the present invention the tray assembly further comprises second securing means associated with the tray container and the cover lid for releasably securing the cover lid to the tray container in the displaying position.

In still another embodiment of the present invention, the tray assembly further comprises compartments within the hollow encasement portion.

The present invention further includes a method of storing and displaying articles on a supporting surface. The method comprises providing a tray container defining a hollow encasement portion, positioning the articles in the hollow encasement portion, pivotally securing a cover lid to the tray container, covering the hollow encasement portion with the cover lid, moving the cover lid from covering the hollow encasement portion, and supporting the tray container with the cover lid at a predetermined tilt angle between the tray container and the supporting surface.

In an embodiment of the present invention, the method further comprises providing the tray container with a base wall, a front wall connected to the base wall, and a back wall connected to the base wall with the method further comprising angling the back wall relative to the base wall.

In another embodiment of the present invention, the method further comprises providing the cover lid with a first cover lid portion and a second cover lid portion with the method further comprising pivotally connecting the first cover lid portion to the tray container and hingedly connecting the second cover lid portion to the first cover lid portion.

In still another embodiment of the present invention, the method further comprises providing first securing means associated with the tray container and the cover lid for releasably securing the cover lid to the tray container in the storing position. Furthermore, the method further comprises providing second securing means associated with the tray container and the cover lid for releasably securing the cover lid to the tray container in the displaying position.

In yet another embodiment of the present invention, the method further comprises providing compartments within the hollow encasement portion.

DETAILED DESCRIPTION OF THE PREFERRED EMBODIMENTS

Figures 1, 2:
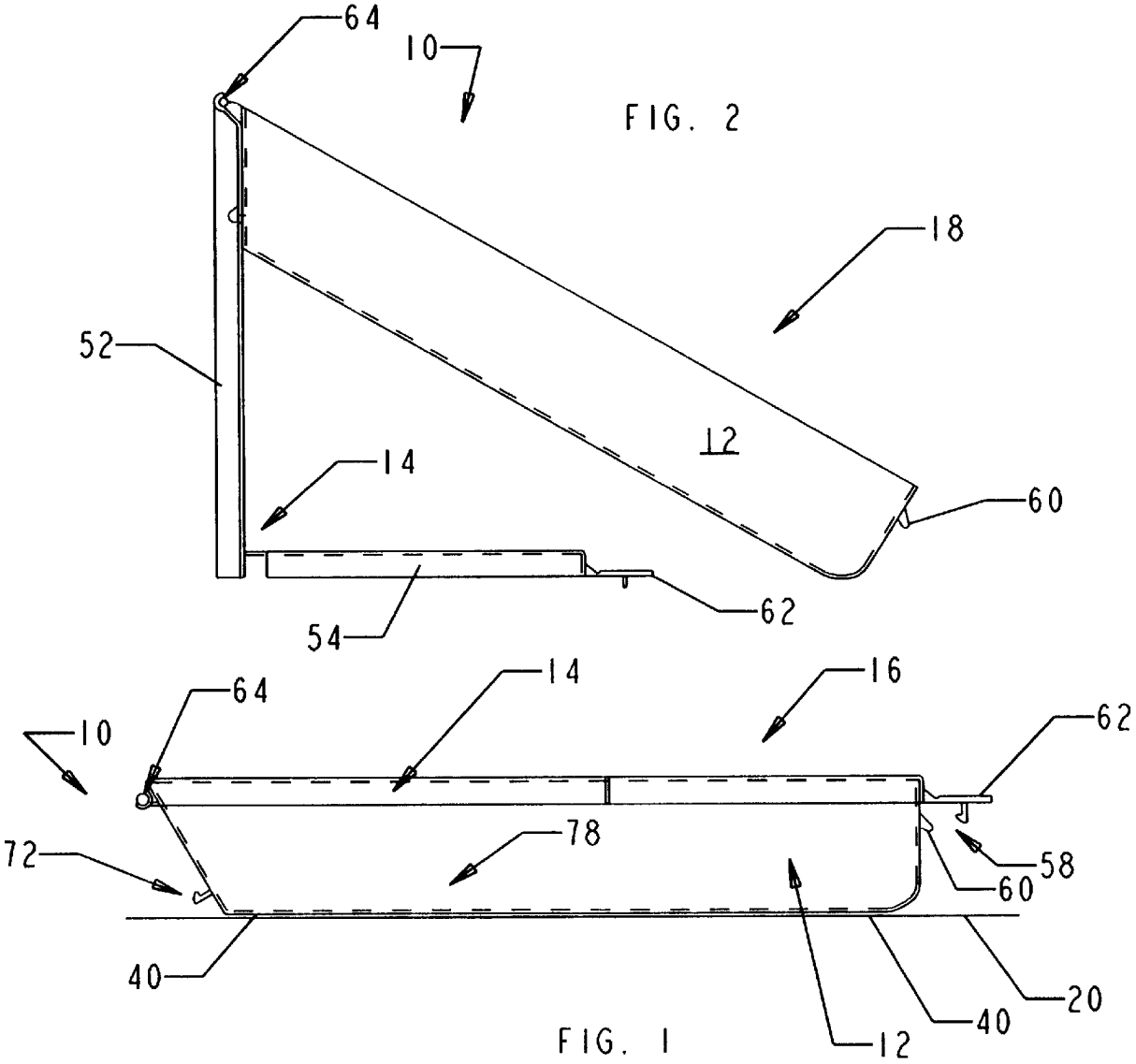
FIG. 1 is an elevational side view illustrating a tiltable tray assembly for storing and displaying articles and the like constructed in accordance with the present invention with the tray and the cover lid of the tiltable tray assembly being illustrated in the storage mode.
FIG. 2 is an elevational side view illustrating the tiltable tray assembly for storing and displaying articles and the like constructed in accordance with the present invention with the tray and the cover lid of the tiltable tray assembly being illustrated in the displaying mode.

As illustrated in FIG. 1, the present invention is a tray assembly, indicated generally at 10, for storing and displaying articles and the like (not shown). The tray assembly 10 has a tray container 12 and a cover lid 14 pivotally mounted to the tray container 12. The cover lid 14 is closable to maintain the tray assembly 10 is a storing mode 16, as illustrated in FIG. 1, and is openable to maintain the tray assembly 10 in a displaying mode 18, as illustrated in FIG. 2, upon a supporting surface 20. The closability and openability of the cover lid 14 into the storing mode 16 and the displaying mode 18, respectively, relative to the tray container 12 will be discussed in further detail below.

Figure 6:
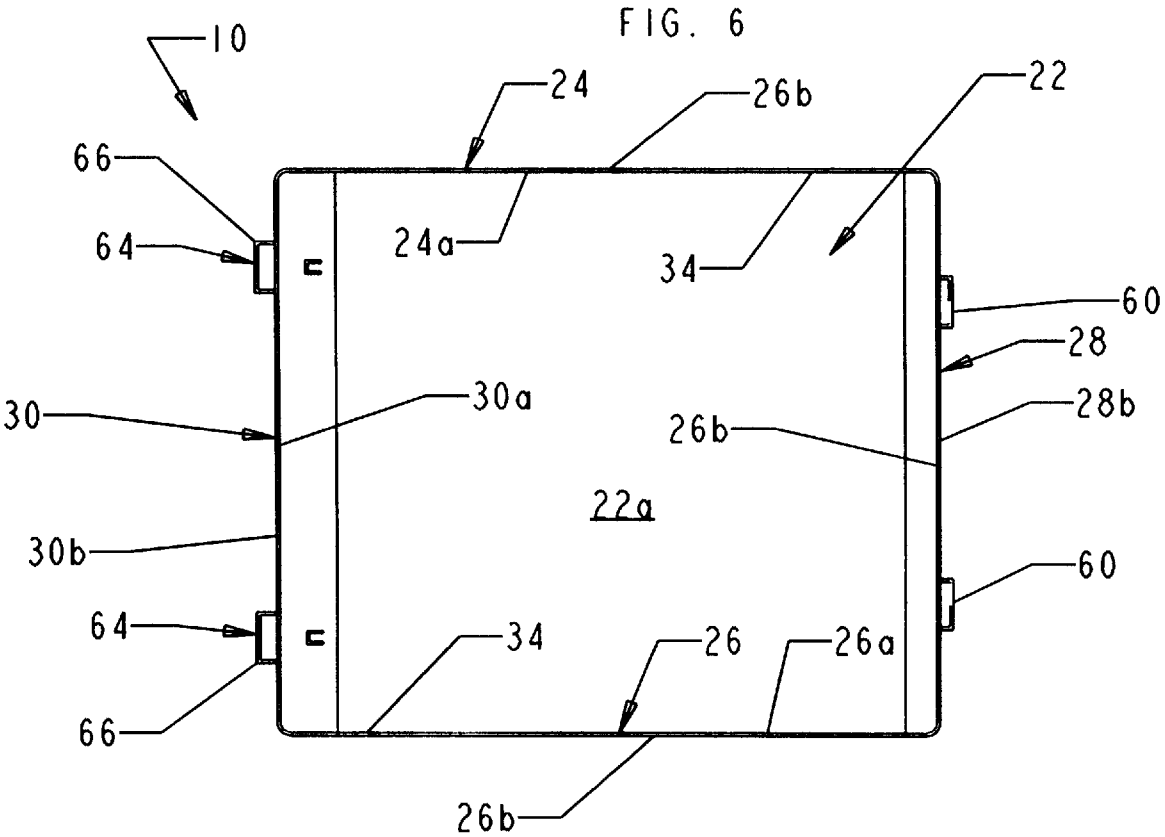
FIG. 6 is a top view illustrating the tray of the tiltable tray assembly for storing and displaying articles and the like constructed in accordance with the present invention.
Figure 5:
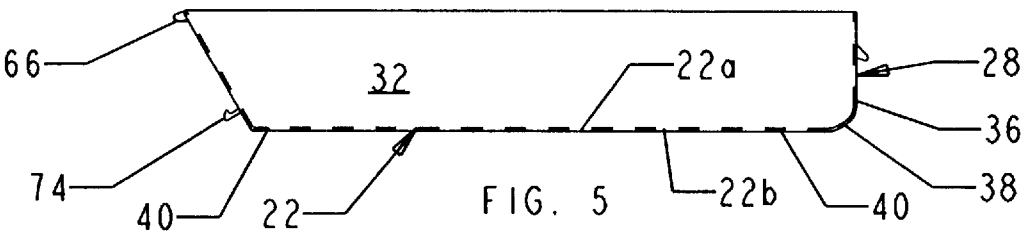
FIG. 5 is an elevational side view illustrating the tray of the tiltable tray assembly for storing and displaying articles and the like constructed in accordance with the present invention.

As illustrated in FIGS. 5 and 6, the tray container 12 has a substantially planar base wall 22, a first side wall 24 connected and substantially perpendicular to the base wall 22, a second side wall 26 opposite the first side wall 24 and connected and substantially perpendicular to the base wall 22, a front side wall 28 connected between the first side wall 24 and the second side wall 26 and connected and substantially perpendicular to the first side wall 24, the second side wall 26, and the base wall 22, and a back side wall 30 opposite the front side wall 28 between the first side wall 24 and the second side wall 26 and connected to the first side wall 24, the second side wall 26, and the base wall 22. Each of the base wall 22, the first side wall 24, the second side wall 26, the front side wall 28, and the back side wall 30 have an inner surface 22*a*, 24*a*, 26*a*, 28*a*, 30*a*, respectively, and an outer surface 22*b*, 24*b*, 26*b*, 28*b*, 30*b*, respectively.

The base wall 22, the first side wall 24, the second side wall 26, the front side wall 28, and the back side wall 30 define a compartment 32 within the inner surfaces 22*a*–30*a* of the tray container 12 for holding the articles therein. Furthermore, each of the first side wall 24, the second side wall 26, the front side wall 28, and the back side wall 30 define a tray container rim 34 for resting the cover lid 14 thereon when the tray assembly 10 is in the storing mode 16.

Preferably, the back side wall 30 is angled relative to the base wall 22 to allow the tray assembly 10 to tilt toward the user and to maintain stability of the tray assembly 10 upon the supporting surface 20 when the tray assembly 10 is in the displaying mode 18. Furthermore, the front side wall 28 has a perpendicular portion 36 and an angled portion 38 between the perpendicular portion 36 and the base wall 22. The angled portion 38 is substantially perpendicular to the angled back side wall 30 to further allow the tray assembly 10 to tilt toward the user with the angled portion 38 of the front side wall 28 contacting the supporting surface 20 to maintain stability of the tray assembly 10 upon the supporting surface 20 when the tray assembly 10 is in the displaying mode 16. Operation of the tray assembly 10 in the storing mode 16 and displaying mode 18 will be described in further detail below.

The tray container 12 further includes a plurality of support members or feet 40 mounted on the outer surface 22*b* of the base wall 22. The support members 40 are positioned between the outer surface 22*b* of the base wall 22 and the supporting surface 20 inhibiting movement of the tray assembly 10 when the tray assembly 10 is in the stacking or storing mode 16.

Figure 8:
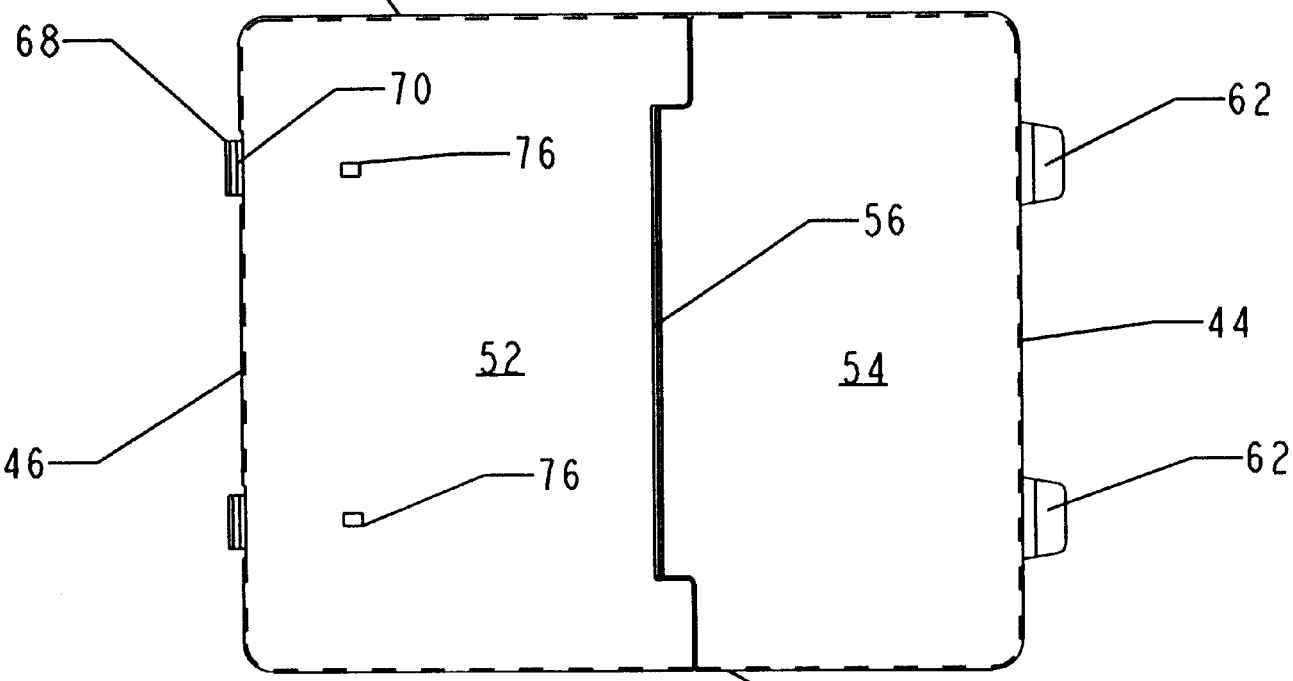
FIG. 8 is a top view illustrating the cover lid of the tiltable tray assembly for storing and displaying articles and the like constructed in accordance with the present invention for biasing the binding apparatus in a generally downward direction.
Figure 7:
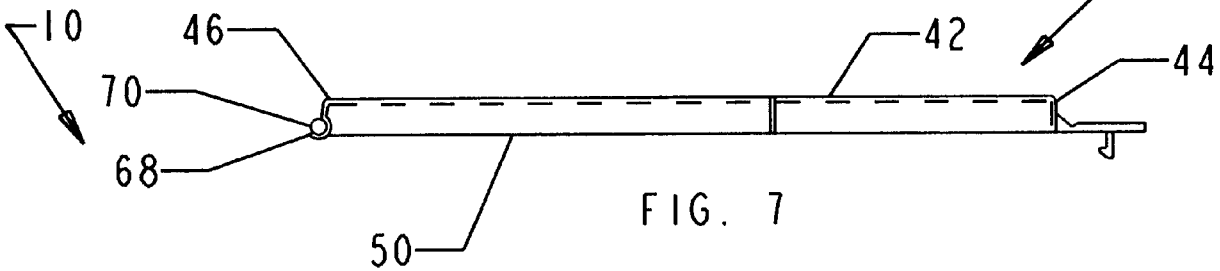
FIG. 7 is an elevational side view illustrating the cover lid of the tiltable tray assembly for storing and displaying articles and the like constructed in accordance with the present invention.
Figure 9:
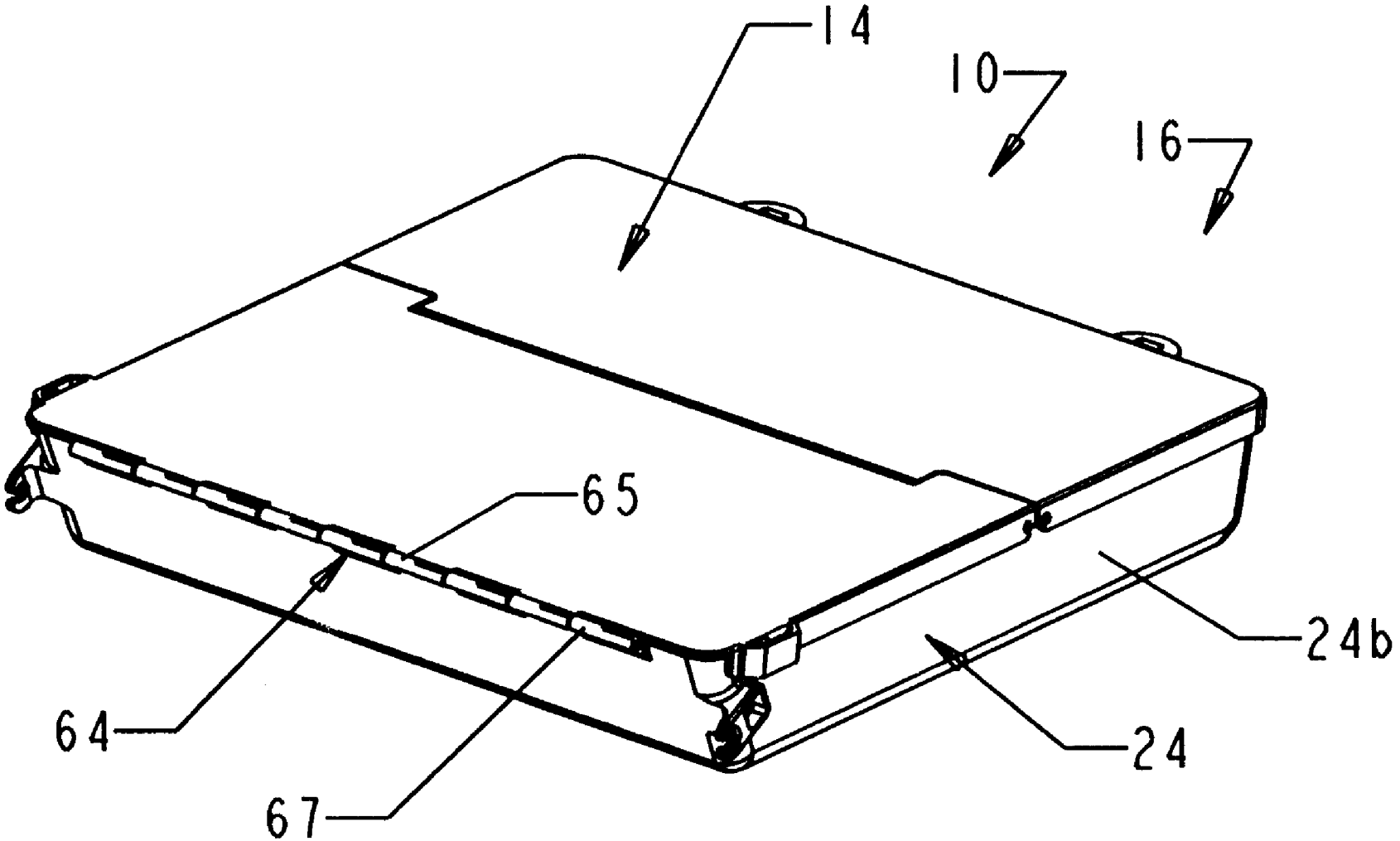
FIG. 9 is a perspective view illustrating another embodiment of the tiltable tray assembly for storing and displaying articles and the like constructed in accordance with the present invention.

As illustrated in FIGS. 7 and 8, the cover lid 14 of the tray assembly 10 of the present invention has a top wall 42, opposite front and back side walls 44, 46 mounted substantially perpendicular to the top wall 42, and opposite first and second side walls 48, 50 mounted substantially perpendicular to the front and back side walls 44, 46 and the top wall 42. The top wall 42 of the cover lid 14, in the storing position 16 of the tray assembly 10, rests upon the tray container rim 34 with the front side wall 44 of the cover lid 14 overlaying the front side wall 28 of the tray container 12, the back side wall 46 of the cover lid 14 overlaying the back side wall 30 of the tray container 12, the first side wall 48 of the cover lid 14 overlaying the first side wall 24 of the tray container 12, and the second side wall 50 of the cover lid 14 overlaying the second side wall 26 of the tray container 12.

Preferably, the cover lid 14 has a first cover lid portion 52 and a second cover lid portion 54 hingedly connected to the first cover lid portion 52. The first cover lid portion 52 is pivotally connected to the back side wall 30 of the tray container 12. A hinge mechanism 56 connects the first cover lid portion 52 to the second cover lid portion 54. Preferably, the hinge mechanism 56 is a living hinge formed in the cover lid 14 although other hinge mechanisms are within the scope of the present invention.

As illustrated in FIG. 1, the tray assembly 10 further includes a storing latching mechanism 58 mounted to the front side wall 44 of the cover lid 14 and the outer surface 28*b* of the front side wall 28 of the tray container 12. Preferably, the storing latching mechanism 58 has a pair of first latching portions 60 mounted on the outer surface 28*b* of the front side wall 28 of the tray container 12 and a matingly connectable pair of second latching portions 62 mounted on the front side wall 44 of the cover lid 14. The second latching portions 62 are movable to releasably connect with the respective first latching portion 60 thereby releasably securing the cover lid 14 to the tray container 12 to inhibit any articles within the tray container 12 from accidentally being dislodged from within the tray container 12 while the tray assembly 10 is in the storing mode 16. While the storing latching mechanism 58 has been described and illustrated as having a pair of first and second latching portions 60, 62, it is within the scope of the present invention to have any type of storing latching mechanism 58 including, but not limited to, snaps, hook and loop fasteners, buckles, etc.

Figure 4:
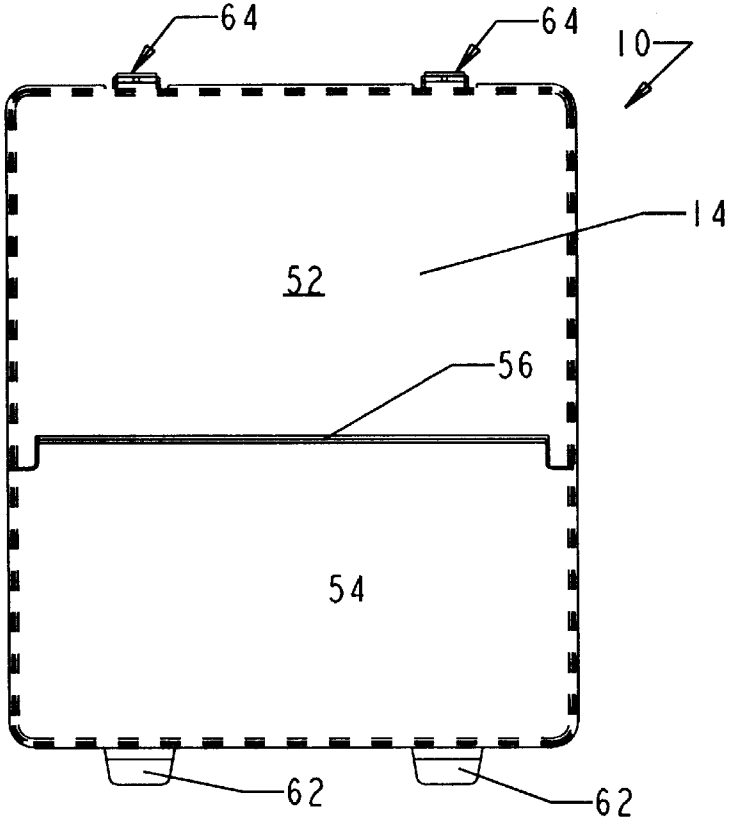
FIG. 4 is a top view illustrating the tiltable tray assembly for storing and displaying articles and the like constructed in accordance with the present invention with the tray and the cover lid of the tiltable tray assembly being illustrated in the storing mode.
Figure 3:
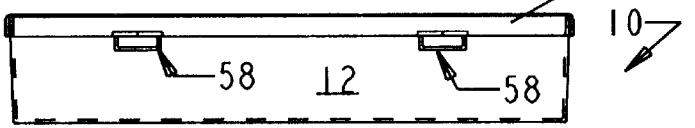
FIG. 3 is an end view of the tiltable tray assembly for storing and displaying articles and the like constructed in accordance with the present invention with the tray and the cover lid of the tiltable tray assembly being illustrated in the storing mode.

As further illustrated in FIG. 1, the tray assembly 10 further has a hinge member 64 between the tray container 12 and the cover lid 14 allowing the cover lid 14 to rotate from the storing position 16 to the displaying position 18. In an embodiment of the tray assembly 10 of the present invention, as illustrated in FIG. 4, the hinge member 64 includes a pair of spaced post members 66 mounted to the outer surface 30*b* of the back side wall 30 of the tray container 12 adjacent the tray container rim 34 of the tray container 12. As illustrated in FIG. 7, the hinge member 64 further includes a pair of finger members 68 mounted to the back side wall 46 of the cover lid 14 with each post member 66 receivable within one of the finger members 68. A protruding portion 70 extending from the back side wall 46 of the cover lid 14 substantially centered in each of the finger members 68 assists in maintaining the cover lid 14 rotatably securable to the tray container 12.

In another embodiment, as illustrated in FIGS. 9–13, the hinge member 64 includes a plurality of hollowed extending portions 65, 67 extending from the outer surface 30*b* of the back side wall 30 of the tray container 12 adjacent the tray container rim 34 of the tray container 12 and extending from the back side wall 46 of the cover lid 14, respectively, with the extending portions 65 mating with the extending portions 67. A pin or rod (not shown) is insertable within the hollowed extending portions 65, 67. It should be noted that while the hinge member 64 has been described and illustrated as a certain type of hinge member, it is within the scope of the present invention to have the hinge member 64 be any type of hinge including, but not limited to, a piano hinge, etc.

As illustrated in FIGS. 1, 5, and 8, the tray assembly 10 further includes a displaying latching mechanism 72 mounted to the outer surface 30*b* of the back side wall 30 of the tray container 12 and the top wall 42 of the cover lid 14. Preferably, the displaying latching mechanism 72 has a pair of first latching portions 74 mounted on the outer surface 30*b* of the back side wall 30 of the tray container 12 and a pair of apertures 76 formed in the top wall 42 of the cover lid 14. As the cover lid 14 is rotated in a generally upward direction away from the tray container rim 34 of the tray container 12, the top wall 42 of the cover lid 14 is positioned nearingly adjacent against the outer surface 30*b* of the back side wall 30 of the tray container 12 until the apertures 76 in the top wall 42 of the cover lid 14 mate with the first latching portions 74 of the back side wall 30 of the tray container 12.

As illustrated in FIGS. 9–13, in another embodiment of the present invention, the displaying latching mechanism 72 includes a receiving portion 75 mounted to the tray container 12 extending beyond the back side wall 30. The cover lid 14 includes a pin 79 releasably receivable within the receiving portion 75. A shroud or cover portion 77 covers the pin to provide strength and protection. It should be noted, as with the storing latching mechanism 58, it is within the scope of the present invention to have the displaying latching mechanism 72 be any type of latching mechanism including, but not limited to, snaps, hook and loop fasteners, buckles, etc.

Preferably, the tray container 12, the first latching portions 60 of the storing latching mechanism 58, the post members 66 of the hinge member 64, the first latching portions 74 of the displaying latching mechanism 72, and the support members 40 are formed from a plastic material through an injection molding, vacuum molding, thermo molding or other process. Likewise, preferably, the cover lid 14, the first and second portions 52, 54 of the cover lid 14, the finger members 68 of the hinge member 64, the protruding portion 70 of the hinge member 64, and the second latching portions 62 of the storing latching mechanism 58 are formed from a plastic material through an injection molding, vacuum molding, thermo molding, or other process. While the tray container 12, the hinge member 64, the storing latching mechanism 58, the displaying latching mechanism 72, and the cover lid 14 have been described as being formed from a plastic material through an injection molding process, it is within the scope of the present invention to form the tray container 12 and/or the cover lid 14 from a different material including, but not limited to, metal, ceramic, wood, glass, etc., through a variety of different processes.

Figures 10, 11:
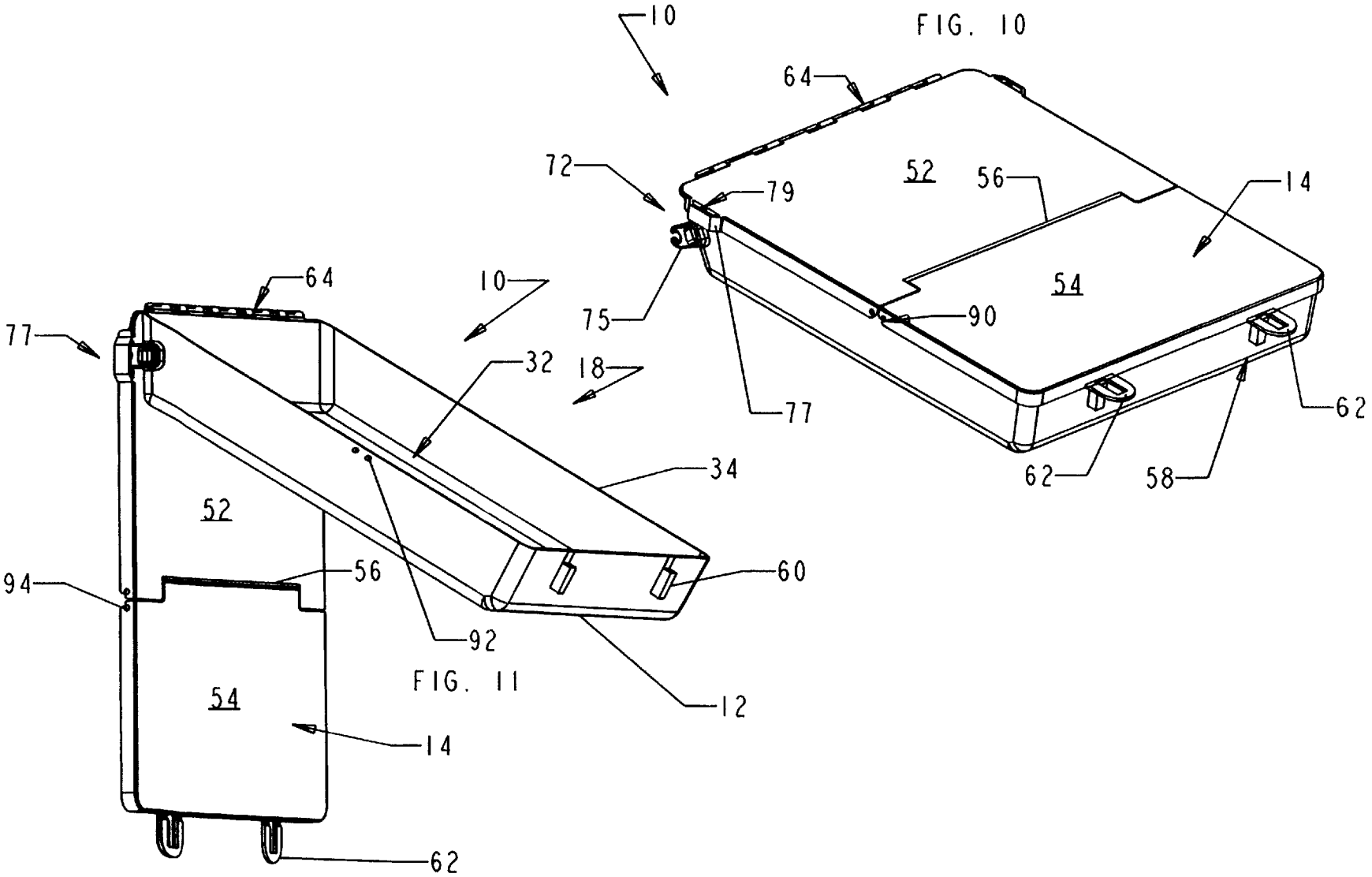
FIG. 10 is a perspective view similar to FIG. 9 illustrating another embodiment of the tiltable tray assembly for storing and displaying articles and the like constructed in accordance with the present invention in the storing mode.
FIG. 11 is a perspective view similar to FIG. 9 illustrating another embodiment of the tiltable tray assembly for storing and displaying articles and the like constructed in accordance with the present invention in the displaying mode.
Figures 12, 13:
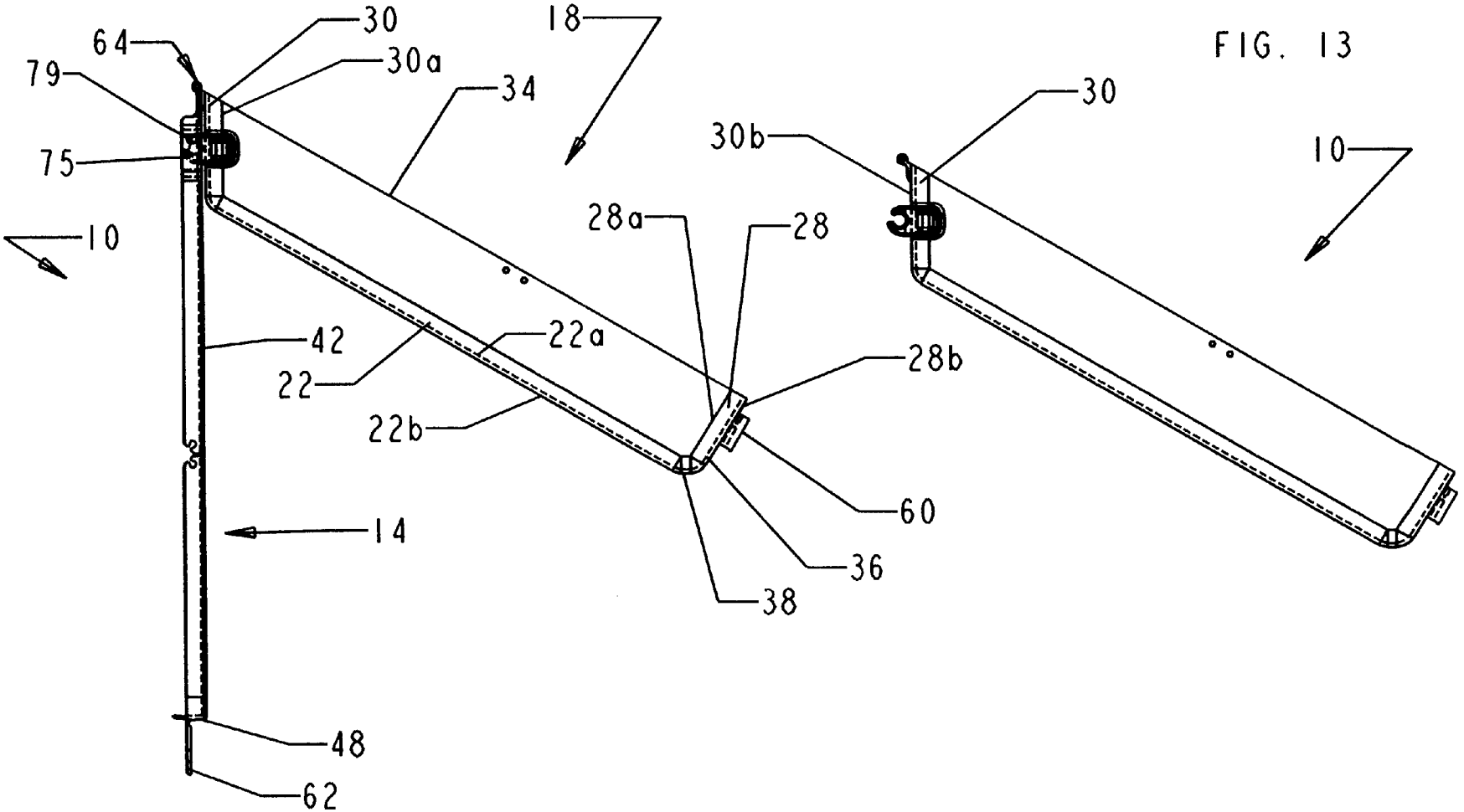
FIG. 12 is a side view similar to FIG. 9 illustrating another embodiment of the tiltable tray assembly for storing and displaying articles and the like constructed in accordance with the present invention.
FIG. 13 is a side view similar to FIG. 12 illustrating another embodiment of the tiltable tray assembly for storing and displaying articles and the like constructed in accordance with the present invention with the cover lid removed.

The operation of the tray assembly 10 of the present invention in both the storing mode 16, as illustrated in FIG. 1, and the displaying mode 18, as illustrated in FIG. 2, will now be discussed. To store and transport articles between desired locations, the cover lid 14 is maneuvered to rest upon the tray container rim 34 of the tray container 12 and the storing latching mechanism 58 is activated. The cover lid 14 is shaped and designed to maintain a position nearingly adjacent the tray container rim 34 to maintain the articles within the tray container 12. If desired, additional latching mechanisms 90, as illustrated in FIGS. 10 and 11, including, but not limited to, a pin 92 mounted on the first and second side walls 24, 26 of the tray container 12 and an aperture 94 formed in the first and second side walls 48, 50 of the cover lid 14 can be provided to assist in maintaining the cover lid 14 nearingly adjacent the tray container rim 34 of the tray container 12 while the tray assembly 10 is in the storing mode 16.

To achieve the displaying mode 18, the storing latching mechanism 58 is first released. The cover lid 14 is then rotated about the hinge member 64 until the first cover lid portion 52 of the cover lid 14 is nearingly adjacent the outer surface 30*b* of the back side wall 30 of the tray container 12. The cover lid 14 is manipulated such that the first cover lid portion 52 is substantially perpendicular to the supporting surface 20 and the second cover lid portion 54 is resting on and substantially parallel to the supporting surface 20. The displaying latching mechanism 72 is then activated to maintain the tray assembly 10 in the displaying mode 18. At this time, the angled portion 38 of the tray container 12 is also resting on and substantially parallel to the supporting surface 20 thereby maintaining the tray assembly 10 in the stable, displaying mode 18.

The tray assembly 10 of the present invention offers a novel and unique manner of storing and displaying articles at an angle to improve the ergonomic posture of the user. While the tray assembly 10 can be designed to display the articles at a variety of angles, preferably, the tray container 12 is tilted at approximately thirty (30°) degrees which provides a comfortable ergonomic angle for most users.

The dimensions of the tray assembly 10 can be of any desired length, width, and height. Preferably, for sewing operations, the tray container 12 has a length of approximately 12.5 inches, a width of approximately 10.5 inches, and a height of approximately 1.75 inches and the cover lid 14 has a length of approximately 12.794 inches, a width of approximately 10.768 inches, and a height of approximately 0.375 inch. When the tray assembly 10 is used for other purposes, the length, width, and height can be greater or lesser than the dimensions previously described.

As illustrated in FIG. 1, one or more partitions 78 of varying size and number can be added and inserted within the compartment 32 of the tray container 12 to provide the user with a variety of sites to place a variety of articles. When the articles are ready to be displayed, the tray assembly 10 of the present invention provides the tray container 12 at an angle so that the articles within the compartment 32 are easily seen and reachable by the user or others. Furthermore, it is within the scope of the present invention to add a handle (not shown) to the top wall 42 of the cover lid 14 to assist the user in transporting the tray assembly 10 between desired locations.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

We claim:

1. A tray assembly for storing articles and displaying articles upon a supporting surface, the tray assembly comprising:

a tray container defining a hollow encasement portion, the hollow encasement portion holding the articles wherein the tray container has a base wall, a front wall connected to the base wall, and a back wall connected to the base wall, the back wall being angled relative to the base wall;

a cover lid pivotally secured to the tray container, the cover lid being movable from a storing position covering the hollow encasement portion to a displaying position wherein the cover lid is movable against the back wall and supports the tray container at a predetermined tilt angle between the tray container and the supporting surface; and first securing means associated with the tray container and the cover lid for releasably securing the cover lid to the back wall of the tray container in the displaying position.

2. The tray assembly of claim 1 wherein the cover lid includes a first cover lid portion pivotally connected to the tray container, a second cover lid portion, and hinge means connecting the first cover lid portion to the second cover lid portion for pivoting the second cover lid portion relative to the first cover lid portion.

3. The tray assembly of claim 1 and further comprising second securing means associated with the tray container and the cover lid for releasably securing the cover lid to the tray container in the storing position.

4. The tray assembly of claim 1 and further comprising compartments within the hollow encasement portion.

5. A storage and display device for storing and displaying articles on a supporting surface, the device comprising:

a tray portion having a base wall, a plurality of end walls, and a plurality of side walls, the end walls and the side walls forming a rim around the tray portion wherein at least one of the end walls is angled relative to the base wall;

a cover lid, the cover lid resting on the rim when the cover lid is in a closed position, the base wall resting on the supporting surface when the cover lid is in the closed position;

hinge means connecting the tray portion to the cover lid for allowing the cover lid to move between an open position and the closed position;

first securing means associated with the tray portion and the cover lid for releasably securing the cover lid to the angled end wall of the tray container in a displaying position; and wherein the cover lid supports the tray portion at an angle relative to the supporting surface when the cover lid is in the open position.

6. The device of claim 5 wherein the cover lid includes a first cover lid portion pivotally connected to the tray portion, a second cover lid portion, and hinge means connecting the first cover lid portion to the second cover lid portion for pivoting the second cover lid portion relative to the first cover lid portion.

7. The device of claim 5 and further comprising second securing means associated with the tray portion and the cover lid for releasably securing the cover lid to the tray portion in a storing position.

8. The device of claim 5 wherein the first securing means includes a receiving member mounted on the tray portion and a pin mounted on the cover lid, the receiving member receiving the pin when the tray container is in the displaying mode.

9. The device of claim 5 and further comprising compartments within the tray container.

10. A method of storing and displaying articles on a supporting surface, the method comprising:

providing a tray container defining a hollow encasement portion and having an angled end wall;

positioning the articles in the hollow encasement portion;

pivotally securing a cover lid to the tray container;

covering the hollow encasement portion with the cover lid;

moving the cover lid from covering the hollow encasement portion;

providing first securing means associated with the tray container and the cover lid for releasably securing the cover lid to the angled end wall of the tray container in a displaying position; and supporting the tray container with the cover lid at a predetermined tilt angle between the tray container and the supporting surface.

11. The method of claim 6 and further comprising providing the cover lid with a first cover lid portion and a second cover lid portion, the method further comprising pivotally connecting the first cover lid portion to the tray container and hingedly connecting the second cover lid portion to the first cover lid portion.

12. The method of claim 10 and further comprising providing second securing means associated with the tray container and the cover lid for releasably securing the cover lid to the tray container in the storing position.

13. The method of claim 10 and further comprising providing compartments within the hollow encasement portion.

* * * * *